United States Patent [19]

Sterling

[11] 4,181,338

[45] Jan. 1, 1980

[54] STRIKE ASSEMBLY

[76] Inventor: John G. Sterling, 888 Country Club Rd., Crystal Lake, Ill. 60014

[21] Appl. No.: 804,898

[22] Filed: Jun. 9, 1977

[51] Int. Cl.[2] ..... E05C 21/02

[52] U.S. Cl. ..... 292/341.17

[58] Field of Search ..... 292/74, 341.17, 341.15, 292/76, 77, 340

[56] References Cited

U.S. PATENT DOCUMENTS

| | | | |
|---|---|---|---|
| 2,468,644 | 4/1949 | Springer | 292/341.17 X |
| 3,690,708 | 9/1972 | Worley et al. | 292/341.17 X |
| 3,713,681 | 1/1973 | Worley | 292/341.17 |

FOREIGN PATENT DOCUMENTS

| | | | |
|---|---|---|---|
| 623497 | 3/1927 | France | 292/341.17 |

*Primary Examiner*—Richard E. Moore

*Attorney, Agent, or Firm*—McCaleb, Lucas & Brugman

[57] ABSTRACT

A jamb mounted strike assembly for use with a door mounted lock or latch, particularly on interior doors, which incorporates movable catch means operable to capture and hold a cooperative door mounted bolt for latching the door in closed position and capable, under impact, to release the bolt to afford emergency door opening operation.

14 Claims, 15 Drawing Figures

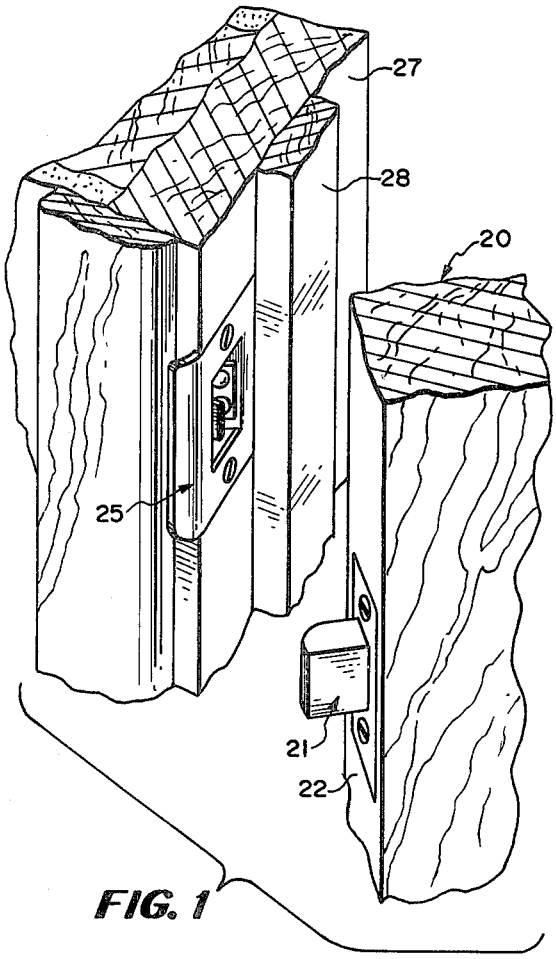
FIG. 1
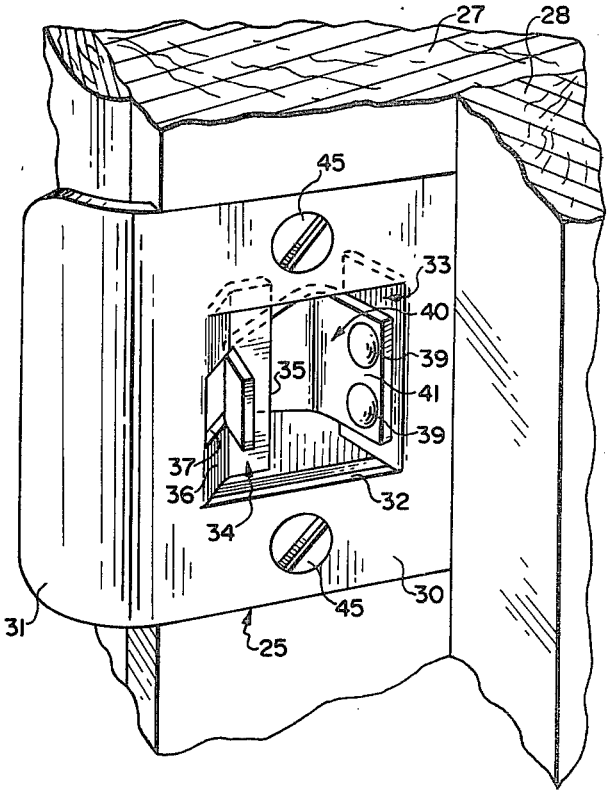
FIG. 2
FIG. 3
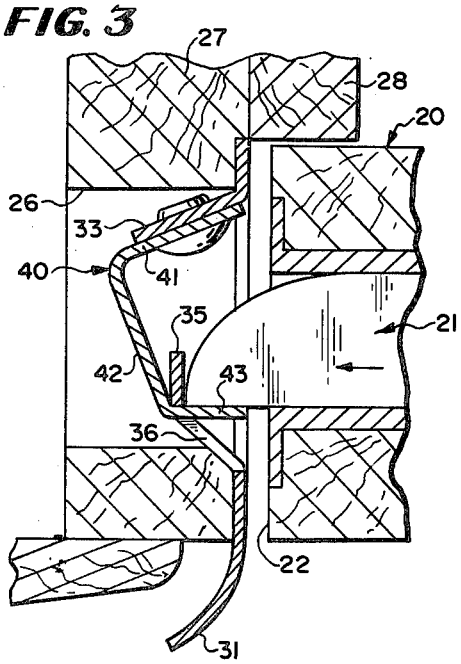
FIG. 4
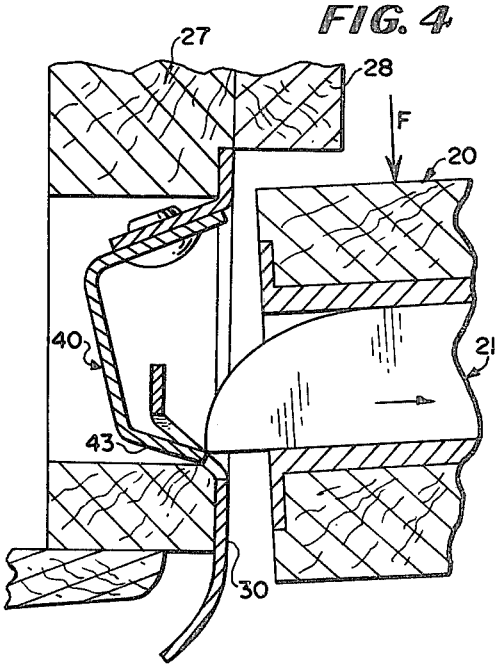

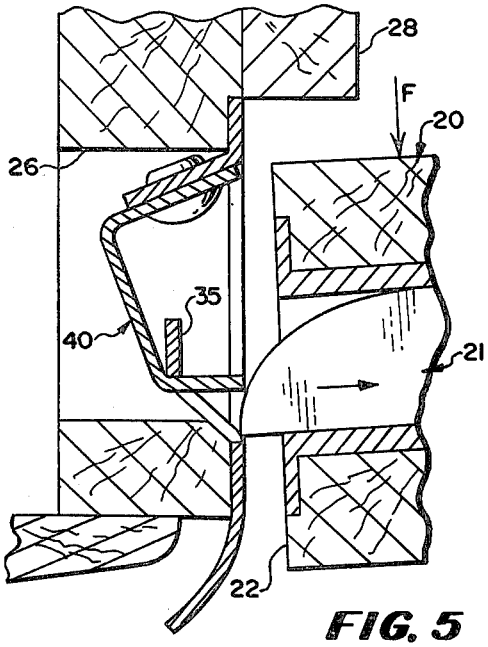
FIG. 5
FIG. 6
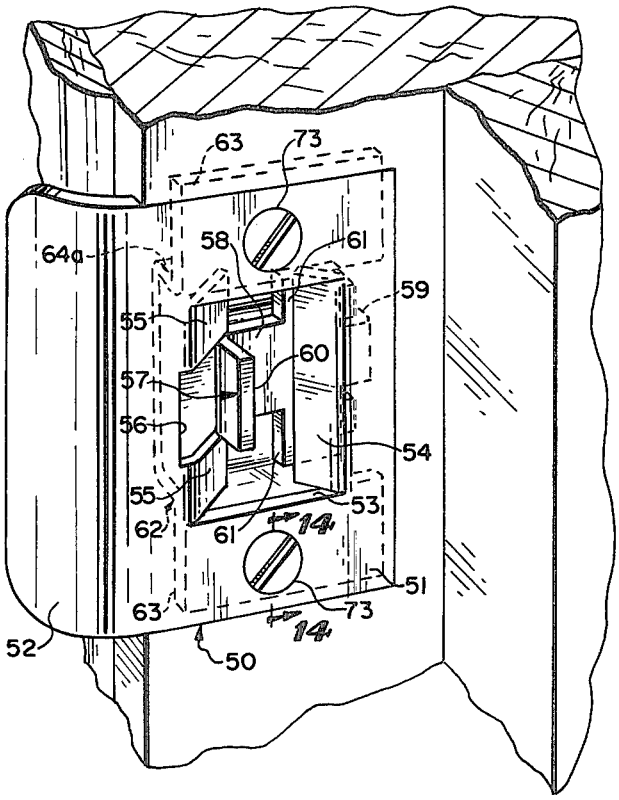
FIG. 7
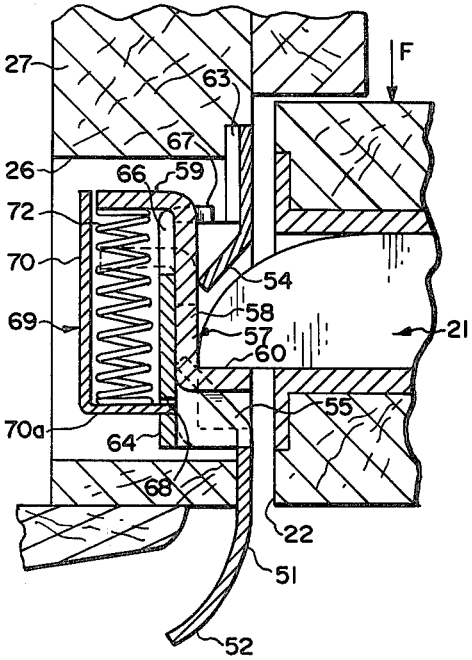
FIG. 7A
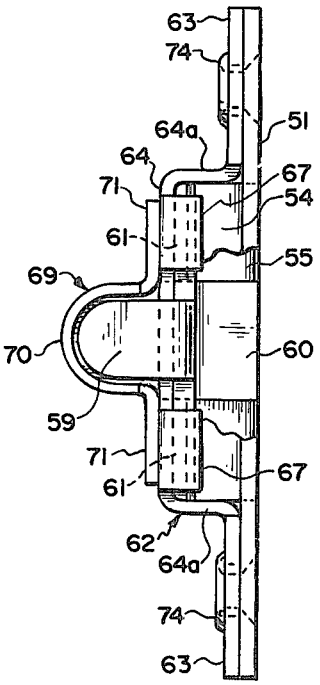

FIG. 8
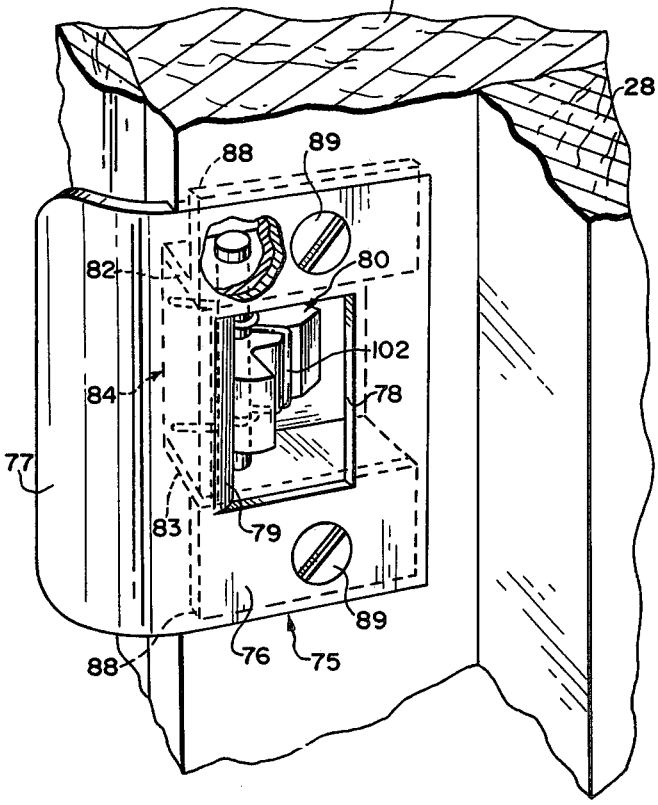
FIG. 9
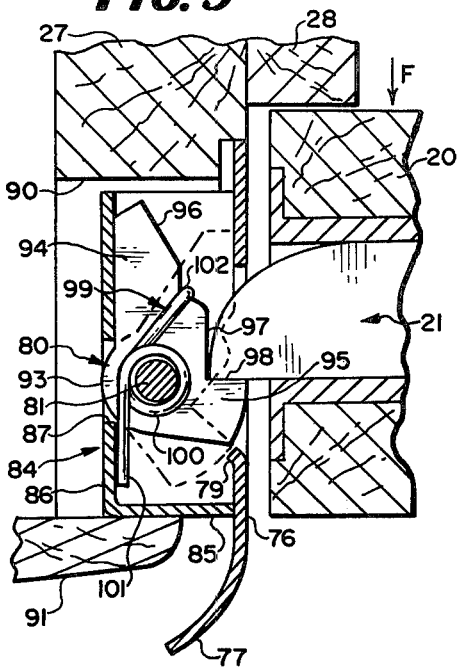
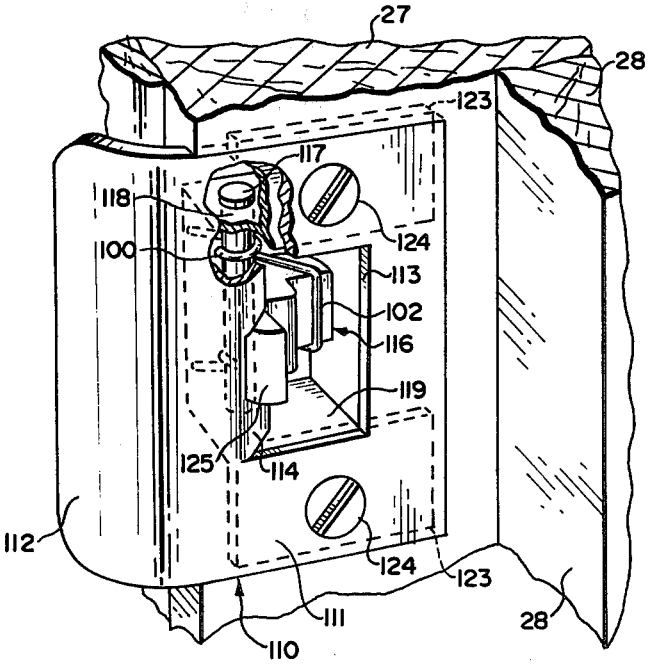
FIG. 10
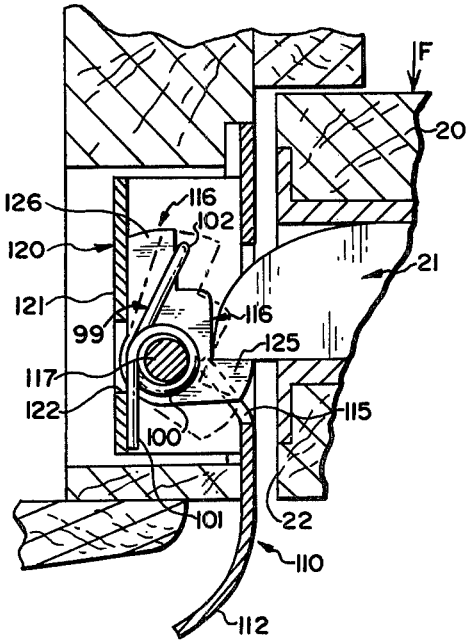
FIG. 11

STRIKE ASSEMBLY

BACKGROUND OF THE INVENTION

Interior door locks have historically followed the basic design concepts employed for exterior door locks which have developed as security devices to prevent or deter forced entry through a locked door. In the general case, interior doors require little more than a simple latching device to secure or maintain a door closed, with possible exception being taken in the case of locks for bathrooms or dressing rooms where a limited degree of privacy is desirable. As a result of this basic adherence to exterior door lock design, interior door latches and locks exhibit serious disadvantages in their inability to be promptly unlocked if broken or jammed, particularly in emergency situations. In recognition of this difficulty, lock manufacturers currently provide various implements or tools to bring about emergency opening operation of a locked door, although in panic situations such tools and implements are often difficult to locate or grossly time consuming and occassionally are found to be inoperative.

SUMMARY OF THE INVENTION

In recognition of the above outlined problem, the present invention is directed to an improved and simplified solution thereto. In that respect this invention bears a common objective with my previously filed application for U.S. Pat. Ser. No. 769,586 filed Feb. 17, 1977 and entitled LATCH BOLT ASSEMBLY, which teaches features and concepts of an improved latch bolt assembly capable of emergency door opening operation.

The current invention relates generally to door hardware and more particularly to an improved jamb mounted strike assembly cooperative with door locks or latches having movable latch bolts.

In brief, the hereinafter described preferred and modified embodiments of this invention illustrated in the drawings employ means embodying a novel concept for a strike assembly, which is useful with both edge or surface mounted door latches and lock assemblies having movable bolt means, for capturing and securing a door in a closed position over a related doorway and which has an inbuilt capability of automatically releasing the bolt means under impact to provide emergency door opening operation. To this end the strike assembly of this invention incorporates means for mounting the same on a door jamb in position for reception of the outer strike engaging end of a door mounted latch bolt. The assembly of subject includes bolt engaging means operable for positively engaging and capturing the door mounted latch bolt whereby to secure an associated door in a closed condition over a related door opening. Additionally such bolt engaging means is operationally movable, by the application of impact force to the closed door, to retract from its bolt capturing position whereby cooperating guide means cause strike escaping operation of the bolt. Thus desired emergency opening operation of a latched door, particularly where the latch bolt is locked against normal retracting operation by associated manual operator means or the like, is readily achieved by this invention.

It is among the important objects of this invention to provide an improved strike assembly having emergency bolt releasing capability.

Still another object of this invention is to provide an improved strike assembly for use with cooperative door latches and locks, either as original manufacture or replacement equipment.

An additional important object of this invention is to provide an improved strike assembly, as aforesaid, operable with a manually actuated latch bolt or the like, for securing an associated door in a closed condition over a related doorway and which strike assembly has the operational capability of automatically releasing the latch bolt for door opening movement independently of the normal manual operation thereof.

A still additional object of this invention is to provide an improved strike assembly, particularly useful with interior door latches and locks, which comprises a movable means for securing a latch bolt thereto and which has the capability of automatically releasing the latch bolt in the presence of appropriate door opening force.

Having thus described this invention, the above and further objects, features and advantages thereof will appear from the following descriptions of preferred and modified embodiments, illustrated in the accompanying drawings and representing the best mode presently contemplated so as to enable those of normal skill in this art to make and practice this invention.

In the drawings:

FIG. 1 is a perspective view showing portions of a door mounted lock and jamb mounted strike assembly according to this invention;

FIG. 2 is an enlarged perspective showing of the jamb mounted strike assembly shown in FIG. 1;

FIG. 3 is a cross-sectional view taken transversely through the door jamb and door illustrated in FIG. 1 and showing the interengaging relationship of the strike assembly and latch bolt when the door is in a closed position;

FIG. 4 is another cross-sectional view similar to FIG. 3, illustrating the bolt releasing operation of the strike assembly;

FIG. 5 is another cross-sectional view, similar to FIGS. 3 and 4, illustrating the relationship of the strike assembly and latch bolt upon release of the door for opening operation;

FIG. 6 is a perspective view, similar to FIG. 2, illustrating a first modified form of strike assembly of this invention;

FIG. 7 is a cross-sectional view, corresponding to FIG. 3, taken transversely through the door jamb, strike assembly and door to demonstrate the bolt capturing operation of the FIG. 6 assembly;

FIG. 7A is a top plan view of the FIG. 6 strike assembly.

FIG. 8 is another perspective view, similar to FIG. 6, illustrating a second modified form of strike assembly according to this invention;

FIG. 9 is a cross-sectional view similar to FIGS. 3 and 7 viewed transversely through portions of the jamb mounted strike assembly and door mounted latch bolt, to illustrate their latched relationship;

FIG. 10 is another perspective view of a third modified form of jamb mounted strike assembly of this invention;

FIG. 11 is a cross-sectional view taken transversely through portions of the jamb mounted strike assembly of FIG. 10 and the door mounted latch bolt to illustrate their latched relationship;

DESCRIPTION OF THE PREFERRED EMBODIMENT

Figure 12:
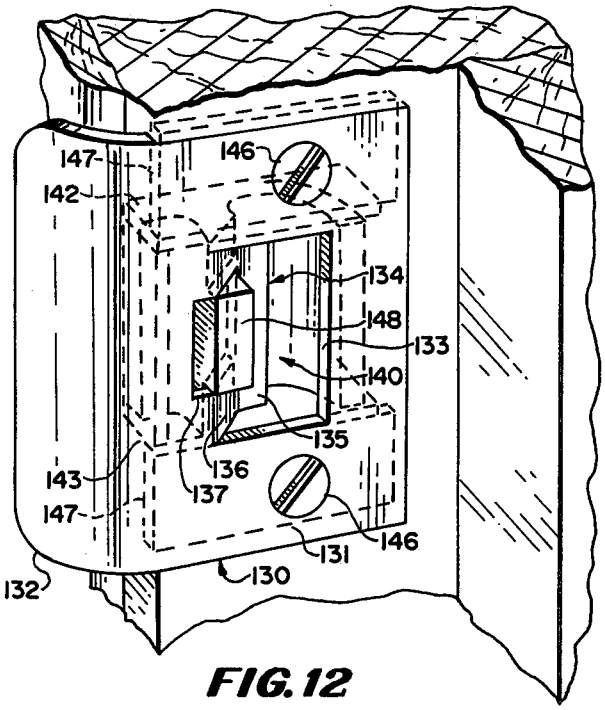
FIG. 12 is still another perspective view, similar to FIG. 10, of a fourth modified form of jamb mounted strike assembly of this invention.

Turning now to the specifics of the preferred embodiment of the invention illustrated in FIGS. 1 through 5 of the drawings, initial reference is made to FIG. 1 which is illustrative of the operational context for this invention. As there shown, a typical hinged or pivotally mounted door 20 is equipped with a conventional lockset having a rectilinearly movable latch bolt 21 which, in the normal order of events, is associated with manual operator means such as manually engageable door knobs and the like (not shown). While the illustrated lock-associated bolt means 21, set out in the current disclosure, relates to a lock assembly mounted inwardly of door edge 22, with the bolt means movable along a generally horizontal axis, it will be appreciated that the principles and concepts of this invention are fully applicable to surface mounted locks and latches having movable bolt means.

It will be recognized that in the usual lockset illustrated, the movable bolt means 21 is generally rectilinearly responsive to manual operator means, such as a pair of rotatable door knobs located on opposite faces of the door, and that such operator means normally have related locking devices or means for preventing manual operation thereof, whereby to lock a door in closed position. While the referred to locking means are not herein illustrated, conventionally the same serve to prevent rotation of the operator spindle associated with the door knobs or other operator means, thus preventing their manual operation and associated bolt movement. In addition, it should be noted that in the common door lock means of the type herein depicted, the movable latch bolt is usually spring biased to its extended position for engagement with the jamb mounted strike. As such the latch bolt may be retracted from its extended condition, as seen in FIG. 1, by compressing its associated spring means without the necessity of actuating its associated operating means. This functioning takes place when closing a door, for intance, whereby the latch bolt is sequentially extended and retracted as it moves over the conventional jamb mounted strike.

With the above general context in mind, the preferred strike assembly 25, as shown in FIGS. 1 and 2, is operationally mounted over a cavity 26 (see FIG. 3) formed inwardly of the outer face of a door jamb member 27; and fitted into a recess mortised in the face of the door jamb to lie substantially flush with the outer surface thereof, adjacent the usual door stop 28. Assembly 25 is operationally aligned with the longitudinal axis of movement for the latch bolt 21 so that the latter is adapted to engage the strike assembly in the course of closing the door against the door stop 28, in a familiar manner. Further, in the normal installation of the type depicted in FIGS. 1-3, for example, edge 22 of the door is usually gapped or spaced from the opposing face of the door jamb member 27 for operating clearance, as shown in FIG. 3.

With specific reference now to the structural makeup and operational concepts of the strike assembly 25, it will be noted from FIGS. 2 and 3, for instance, that the same includes a generally rectangularly spaced planar body or strike plate 30 having an outwardly turned bolt engaging lip portion 31 along one edge thereof which extends protectively over the outer edge of the jamb member 27 in operation. Plate 30 is provided with a central bolt receptive strike opening 32 preferably formed by piercing and punching operations to provide a pair of inwardly extending leaf portions 33 and 34, each integral with one operationally vertical margin of opening 32. Each of the leaf portions 33 and 34 is angularly disposed with respect to the plane of the plate 30 and is operationally positioned to extend into the cavity 26 formed in the door jamb 27, (see FIGS. 2 and 3). It will be noted in particular that leaf portion 33, located furthest from the lip 31, is planar in formation while the other leaf portion 34 is angulated in formation to provide a pair of angularly intersecting planar arm portions 35 and 36. Portion 36 is formulated with a central rectangular shaped catch opening 37 which extends substantially between the outer face of the strike plate 30 and the intersection of the two arm portions 35 and 36. While arm portion 36 is angularly disposed with respect to the plane of plate 30, the secondary arm portion 35 is disposed substantially parallel to such plane (see FIG. 3).

Attached to the leaf portion 33, as by rivet connectors 39, 39, is a catch element 40 constructed of spring metal so as to readily flex about its connection with the supporting leaf portion 33. Element 40 is formed to include a planar base portion 41 which is riveted or fastened to the leaf portion 33 and an intermediate arm portion 42, integral with and interconnecting the base portion 41 with a terminal finger portion 43. The several portions 41-43 of the catch element 40 are in angular disposition with respect to each other and are suitably dimensioned so that the finger portion 43 thereof may extend through opening 37 in arm portion 36, normally to lie substantially at right angles to the plane of the strike plate 30 (see FIGS. 2 and 3).

To facilitate mounting of the strike assembly 25 on the jamb member 27, suitable mounting screws 45, 45 are provided to fit through appropriate openings in the strike plate 30 for threaded engagement with the jamb member 27 in a conventional manner.

USE AND OPERATION OF PREFERRED FORM

With reference to FIGS. 3, 4 and 5 of the drawings, the operational characteristics and functioning of the above described assembly 25 will now be set forth.

As shown in FIG. 3, when door 20 is closed against the door stop 28, the spring loaded latch bolt 21 thereof extends into opening 32 of the strike plate, engaging the opposing catch finger 43 protruding outwardly through opening 37 in arm portion 36. It is to be noted that the arm portion 35 abuts the catch finger 43 to act as a stop barrier limiting movement of the finger toward the strike plate and aligning the same in bolt engaging position. The arm portion 35 also acts as a stop or barrier to latch bolt 21, engaging the outer end thereof and preventing the same from entering or moving into the strike opening 32 beyond a predetermined distance. This latter feature in particular permits variation of the gap between the door and jamb without changing the interlocking engagement between the latch bolt and catch finger 43.

Upon application of door opening force, as indicated by arrow F in FIG. 4, door opening movement is initiated even though the portion of bolt 21 extending into strike opening 32 is held by the catch element. This activity is brought about because of the resilient nature of element 40 which operates to release the latch bolt by moving in a retracting direction, as viewed in FIG. 4; the finger 43 thereof in particular retracting through opening 37. As soon as the bolt starts to move in a door opening direction, the sloping surfaces on opposite sides of opening 37 in leaf portion 36 engage the outer end of the latch bolt 21 and act as inclined guide means for forcibly moving the bolt toward the outer surface of strike plate 30, compressing the bolt biasing spring means in the process. In this respect it is to be noted that such retracting operation of the latch bolt may take place regardless of the locked or unlocked condition of its associated manual operator means, and is particularly effective in the locked condition thereof for opening the door in emergency situations.

With the continued application of opening force to the door, the bolt means 21 is eventually moved to full strike escaping position, as illustrated in FIG. 5. At this point the door is free to complete full opening movement. As the outer end of the latch bolt 21 moves into engagement with the front face of the strike plate 30, the resilient catch finger 43 thereof returns to its normal operating position against arm portion 35, ready to recapture the bolt means 21 upon subsequent door closure.

From the foregoing, it will be recognized that the improved assembly 25 hereinabove described, provides a simple, effective means for positively holding a door associated latch bolt to maintain a door in a closed and latched condition and yet permits emergency opening of the door by the application of appropriate door opening forces without the necessity of manually operating or retracting the latch bolt. Thus the emergency opening objective of this invention is achieved.

First Modified Form

Turning now to FIGS. 6, 7 and 7A of the drawings, a first modified form of the previously described assembly 25 is illustrated and designated generally as 50. Assembly 50 includes a planar strike plate 51 having an outwardly turned lip portion 52 along one operationally vertical margin thereof and a central strike opening 53 formed by piercing and stamping plate 51 to provide angularly inwardly extending leaf portions 54 and 55, 55. Leaf portions 55, 55 are separated by a central opening 56 which extends into the strike plate 51 for cooperation with a modified catch means 57.

The catch means 57 comprises a rigid generally Z-shaped rigid metal stamping, having a central planar body 58 formed with oppositely extending finger portions 59 and 60 projecting at right angles from its outer ends (see FIG. 7). In addition to finger portions 59 and 60, body 58 also includes a pair of coplanar laterally extending guide arms 61, 61 (see FIGS. 6 and 7A) which are located near the one finger portion 59 to stabilize the body in operation, as will appear presently.

A rigid cage means 62 is provided to support the catch means 57 for translating movement behind the strike plate. To that end, cage means 62 includes a pair of coplanar mounting ears 63, 63 at its operationally vertical extremities, which are offset from a parallel back plate 64 by integral right angularly related wall portions 64a. The back plate has a symmetrically located cut-out 66 in one edge which is flanked by a pair of right angularly projecting stop lugs 67, 67 and a rectangular-shaped opening 68 is provided near the opposite edge thereof (see FIG. 7).

A spring cage 69 is mounted centrally behind the back plate 64 and includes a central guide tube portion 70, flanked by mounting platforms 71, 71 which are spot welded to the back plate. An inwardly bent end portion 70a of the guide tube closes over one end thereof and invades opening 68 for attachment with the back plate in assembly (see FIG. 7). A compression coil spring 72 is housed in the guide tube 70; one end thereof abutting the end wall 70a, and the opposite end thereof having operating engagement with finger portion 59 of the catch means. In this regard it will be noted that the outer end of finger portion 59 is radiused to clear the guide tube 70 for movement therewithin (see FIG. 7A).

In assembly, the cage means is fixed to the back face of the strike plate, with catch means 57 slidingly mounted between the inwardly sloping strike plate leaf portions 54 and 55, 55 and the back plate 64 of the cage means. As above noted, the one finger portion 59 of the catch means extends over one end of the spring means 72 for movement along the cut-out 66 in the back plate, while the second finger portion 60 projects through opening 56 of the strike plate. The two guide arms 61, 61 of the catch means are located behind and are engageable with the spaced stop lugs 67, 67 of the cage means to limit movement of the catch means in a bolt capturing direction.

Figure 14:
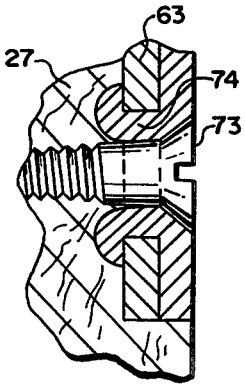
FIG. 14 is an enlarged cross-sectional view taken substantially along vantage line 14—14 of FIG. 6.

Connecting of the cage means to the strike plate 51 may be accomplished in the manner illustrated in FIG. 14 of the drawings from which it will be recognized that means for passage of mounting screw means 73, 73, used to fasten the strike assembly 50 over cavity 26 in the door jamb member, are provided by piercing and forming the material of the strike plate to form inwardly extending tubular portions 74, receptive of the mounting screws 73. The outer ends of such tubular portions pass through and are riveted over behind the cage mounting ears 63 to secure the latter against the back face of the strike plate. This system of mounting the cage means to the strike plate in assembly 50 is generally followed in all of the hereinafter described forms of the current invention, althought other fastening systems, such as spot welding, may be employed for this purpose.

With particular reference now to FIG. 7 of the drawings, it will be understood that modified assembly 50 operates in a manner generally similar to that of the first described assembly 25 in that finger portion 60 of the catch means projects through opening 56 in the strike plate to operatively capture the outer end of the retractable bolt 21 within the strike plate opening 53, as indicated by the full line showing of such portion 60 in FIG. 7. This holds the door 20 in closed position against the door stop 28. On the other hand, when opening force F is applied to the door 20, catch means 57 slides in the direction of door opening movement to release the latch bolt 21, compressing spring 72 in the process. This permits the latch bolt to ride over the inclined guide surfaces formed on opposite sides of opening 56 by the leaf portions 55, 55, to resultantly force the bolt toward the outer face of the strike plate and cause the same to escape the strike plate opening 53. This action affords full door opening operation without the necessity of manually retracting the bolt means 21. Return movement of the catch means to its bolt capturing position is brought about by the spring means 72. Thus emergency opening operation of assembly 50 in accordance with that objective of this invention is achieved.

Second Modified Form

With reference now to FIGS. 8 and 9 of the drawings, it will be recognized that such figures correspond to FIGS. 6 and 7 and illustrate the features of a second modified strike assembly 75 of this invention. As shown in FIG. 8, for example, assembly 75 is adapted to be mounted on the jamb 27, substantially as the heretofore described assemblies 25 and 50.

Briefly, assembly 75 comprises a planar strike plate 76 having an outwardly turned lip portion 77, along one operationally vertical margin thereof, which protrudes beyond and protectively extends over the outer marginal edges of the jamb member 27. Plate 76 is appropriately recessed in the jamb member and positioned for interengagement with the retractable bolt means 21 carried by an associated door lock or latch means, as heretofore set forth.

As in the two previously described assemblies 25 and 50, the strike plate 76 of assembly 75 is provided with a generally centrally disposed rectangular shaped strike opening 78 for reception of the outer end of the bolt means 21, whereby to effect interengagement of the latter with the assembly 75. It will be noted, however, that opening 78 is bordered along one operationally vertical margin with only one leaf portion 79, as seen best in FIG. 9. Leaf portion 79 extends inwardly of opening 78 in angular disposition to the plane of formation for the strike plate 76, but projects only a short distance beyond of the inner face thereof. This permits movement therepast of a modified catch means 80 mounted for rotational movement about an operationally vertical spindle or axle 81 secured at its ends to and extending between parallel spaced top and bottom walls 82 and 83 of a supporting cage means 84.

Cage means 84 departs somewhat from the cage means 62 used in the above described assembly 50 in that the same includes, in addition to the top and bottom walls 82 and 83, a side wall 85 integral with and extending at right angles to a back wall 86 thereof (see FIG. 9). Side wall 85 is dimensioned to extend between the back wall 86 and the rear face of the strike plate 76 so as to enclose the front side of the cage means 84, for reasons which will appear presently. In addition, the back wall 86 of the cage means is provided with an opening 87 to afford operational clearance for the catch means 80.

The top and bottom walls 82 and 83 of the cage means are formed integrally with a pair of coplanar mounting ears 88, 88 which are rivet connected to the back face of the strike plate 76 of assembly 75 in the same manner as described for the modified assembly 50 hereinabove (see FIG. 14). Mounting screws 89, 89 pass through appropriate openings in the strike plate and the mounting ears 88 to secure the assembly 75 to the door jamb 27, in the same manner described for mounting assembly 50.

As mentioned, cage means 84 of the assembly 75 includes the side wall 85. This constitutes a change over the previously described cage means 62 of assembly 50, and is brought about principally by virtue of the modified catch means 80 of assembly 75, which requires a greater operating space than the corresponding catch means 57 of assembly 50. In particular, cage means 84 has a greater front to back dimension than the cage means of assembly 50. While cage means 84 could be mounted in a cavity cut in the door jamb, such as cavity 26 utilized in the described assemblies 25 and 50, it is preferred to modify the mounting cavity 90 therefor by cutting the same inwardly of the front or leading edge of the jamb member 27, thereby providing an open sided cavity therein (see FIG. 9). The open side of cavity 90 is partially overcovered by the usual trim strip 91; wall 85 of the cage means 84 enclosing the remainder thereof.

As above noted, the assembly 75 incorporates a modified catch means 80 which best may be formed as a diecast unit to comprise a bell crank having a generally cylindrical and centrally disposed hub 93 (see FIG. 9) receptive of the mounting axle or spindle 81 and formed integrally with a pair of angularly related arm portions, namely a stop arm portion 94 and a catch arm portion 95, extending outwardly of such hub.

Stop arm portion 94 is configured to extend outwardly from the hub 93 a distance sufficient to engage the rear or back face of the strike plate 76 in the bolt releasing position for the catch means, as indicated by dotted lines in FIG. 9. To that end, arm portion 94 is provided with an angularly disposed stop face 96 engageable with the back face of the strike plate near the strike opening 78. This serves to limit the rotational movement of the catch means 80 in a bolt releasing direction.

The catch arm portion 95 also extends from hub 93 and is configured to provide a pair of right angularly related surfaces 97 and 98, the former of which acts as a stop to limit entry of the latch bolt means 21 in opening 78 when the catch means 80 is positioned in its bolt capturing position, as shown in FIG. 9. Surface 98, on the other hand, is adapted to lie substantially at right angles to the plane of the strike plate 76 when the catch means 80 is in its bolt capturing position, whereby to engage the leading face of the latch bolt. Surface 98 also is disposed in substantial alignment with the angularly extending leaf portion 79 of the strike plate when stop surface 96 is engaged with the back of the strike plate (see its dotted line position in FIG. 9). Importantly, therefore, surface 98, in conjunction with the angulated disposition of the leaf portion 79, provides an angularly disposed ramp or guide means to produce retracting movement and strike escaping operation of the bolt means in response to door opening forces in this form of the invention.

In order to provide for return activity and movement of catch means 80, a return spring 99 is provided, the same being formed generally U-shaped with separated legs having intermediate convolutions or turns 100 embracing the spindle 81 on opposite sides of the catch means 80 and including terminal end portions 101 engageable with the inside face of wall 86 for the mounting cage. The separated legs of the spring means are cross-connected by a transverse arm 102 which extends across arm 94 of the bell crank shaped catch means 80, as best shown in FIG. 9. With this arrangement, the spring means 99 acts to rotatably bias the latching means 80 until the stop arm 94 thereof engages the back wall 86 of the mounting cage. This places the catch arm 95 in its normal bolt capturing position as indicated in full lines in that Figure.

When opening force is applied to the door, and the catch means 80 and latch bolt 21 are engaged as shown in FIG. 9, means 80 pivots against the force of spring 99, moving in a bolt releasing direction, as viewed in FIG. 9, until stop surface 96 thereof engages the strike plate.

The latch bolt simultaneously moves across the angularly disposed surface 98 of the catch means, as seen in dotted lines in FIG. 9, and thereby is driven in an unlatching direction until it eventually engages the sloping leaf portion 79 and escapes the strike plate to afford emergency opening of the door.

Third Modified Form

A third form of strike assembly is illustrated in FIGS. 10 and 11 of the drawings, as indicated generally by numeral 110 therein. As shown, assembly 110 comprises a planar strike plate 111 having a curvilinear lip portion 112 along one margin thereof. Plate 111 is adapted for mounting in a recess formed inwardly of the outer surface of the door jamb member 27 such that the lip portion 112 overhangs or extends laterally over the leading edge of the jamb member in position to engage the outer end of a door mounted retractable latch bolt means 21, as in the heretofore described assemblies.

Strike plate 111 is provided with a generally centrally disposed rectangular shaped strike opening 113, receptive of the latching end of the latch bolt 21 and which opening is bordered at one operationally vertical margin by an angularly inward extending leaf portion 114 formed with a centrally located rectangular opening 115 for the passage of a modified catch means 116.

Catch means 116 is mounted for pivotal movement about an operationally vertically disposed spindle or axle 117 carried between top and bottom walls 118 and 119, respectively, of a mounting cage 120. For all intents and purposes cage 120 is substantially identical to the cage means 66 of the heretofore described assembly 50, except that a rear wall 121 thereof is provided with an opening 122 to operationally clear the catch means 116, as shown in FIG. 11. Cage 120 is provided with two mounting ear portions 123, 123 projecting vertically from the outer edges of the top and bottom walls 118 and 119 thereof so as to abuttingly engage the inside face of the strike plate 111 for connection therewith in accordance with the previously described connective system illustrated in FIG. 14 of the drawings. Assembly 110 is fastened to the jamb member by mounting screws 124, 124.

Generally speaking, the modified assembly 110 is very similar to the previously described assembly 75 except for formation of the leaf portion 114 and the structural aspects of the modified catch means 116.

The basic difference between the leaf portion 114 and its counterpart 79 in assembly 75 resides in its angular extent and the provision of the central opening 115 therein for passage of the catch means 116. Consequently, instead of the catch means moving past the outer end of leaf portion 79 as in assembly 75 (see FIGS. 8 and 9), catch means 116 of assembly 110 moves through the opening 115 in leaf portion 114 thereof.

The modification of catch means 116 over catch means 80 of assembly 75 resides principally in the extent of one arm of its bell crank formation. Specifically, as best shown in FIG. 11, means 116 comprises a bell crank mounted to pivot about the pivot axle 117 and spring biased to a bolt capturing position by means of the same spring means 99 utilized in assembly 75. That is to say spring means 99 is U-shaped and includes a pair of laterally spaced legs, each with spring convolutions 100 for embracing the axle 117. An arm portion 102, cross connects the spring legs and embraces one arm of the bell crank shaped catch means, while a pair of terminal ends 101 thereof engage the back wall 121 of the cage means 120, as in the described assembly 75.

Catch means 116 preferably is diecast to present a pair of right angularly related arm portions 125 and 126; arm portion 125 constituting a bolt engaging arm corresponding to arm 95 of the heretofore described catch means 80, while the secondary arm 126 corresponds to the stop arm 94 thereof. It is to be noted that as opposed to the elongated formation of the stop arm 94 of catch means 80 in assembly 75, arm 126 of the catch means 116 is foreshortened thereover. As a consequence, arm 126 does not act as a stop arm for limiting bolt releasing movement of catch means 116.

On the other hand, the primary bolt engaging arm 125 of means 116 serves to capture the outer end of the latch bolt means 21 and is normally positioned by operation of the spring means 99 to extend generally at right angles to the plane of the latch plate for engagement with the strike bolt, as shown in FIG. 11.

In operation, when the latch bolt is engaged with arm 125, application of thrust or impact force to the door 20 causes catch means 116 to rotate about its mounting spindle 117 in a bolt releasing direction, as viewed in FIG. 11; retracting through opening 115 in leaf portion 114 as the latch bolt moves thereagainst. The sloping surfaces on opposite sides of opening 115 in leaf portion 114 serve to guide or cam the latch bolt effectively toward the strike plate, causing the same to escape strike opening 113 with door opening movement. Thus, the assembly of FIGS. 10 and 11 satisfies the emergency opening objective of this invention.

Fourth Modified Form

Figure 13:
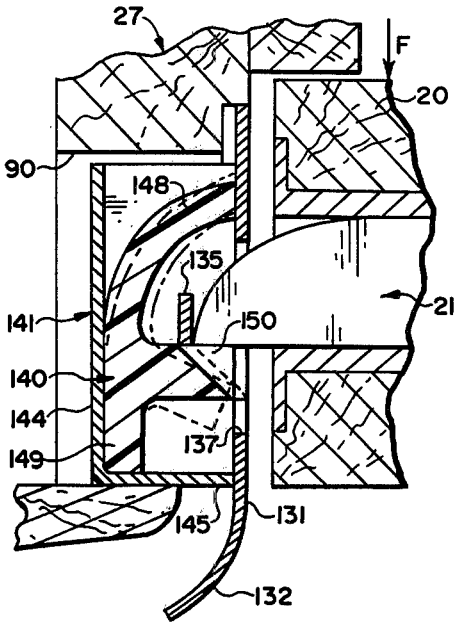
FIG. 13 is a cross-sectional view, similar to FIG. 11, taken through portions of the jamb mounted assembly of FIG. 12 and the door mounted latch bolt to illustrate the latched condition thereof.

In FIGS. 12 and 13 an additional modified strike assembly 130 is shown, comprising a planar strike plate 131, having an outwardly turned lip portion 132 along its outer operationally vertical margin and adapted for mounting on the door jamb 27 in interposing relationship to a cooperating door mounted latch bolt 21, in the same manner as the above described assembly 75 in FIG. 8.

Strike plate 131 is distinguished by a substantially centrally disposed, rectangular shaped strike opening 133, having an angularly inwardly extending leaf portion 134 formed integrally with one margin thereof. Leaf portion 134 comprises a pair of angularly related arm portions 135 and 136, corresponding with and substantially identical to the corresponding arm portions 35 and 36 of the first described assembly 25 of this invention. A catch opening 137 is formed through the angularly disposed arm portion 136 and also invades an adjacent marginal portion of the strike plate for passage of a modified catch means 140.

A mounting cage 141 encloses the catch means 140 and is generally similar to the described cage means 84 of assembly 75 shown in FIGS. 8 and 9, except that the top and bottom walls 142 and 143 thereof do not support a spindle or axle for the catch means, and the back wall 144 thereof does not have an opening for clearance of the catch means, as in assembly 75. Cage 141, however, does include a corresponding side wall 145 which extends between the back wall 144 and the strike plate 131, to close the open side of the mounting cavity 90 cut in the door jamb 27, as previously related. As in assembly 75, suitable mounting screws 146, 146 pass through coplanar mounting ears 147, 147 extending from the top and bottom walls of the cage means; such mounting ears being fixed to the back side of the strike plate in accordance with the described fastening system illustrated in FIG. 14 of the drawings.

As shown best in FIG. 13, the modified catch means 140 of the assembly 130 is quite different from any of the catch means for the previously described assemblies in that the same is formed of elastomeric materials, such as resilient plastic or semihard rubber. It is to be noted that the dimensioning of the catch means 140 is such as to extend substantially from and between the top and bottom walls of the mounting cage, engaging such walls with light resilient contact.

Structurally, means 140 is somewhat T-shaped in cross-section, as shown in FIG. 13, to include a curvilinear arm portion 148, the outer end of which abuts the back face of the strike plate adjacent one margin of strike opening 133, opposite the leaf portion 134. The curvilinear arm portion 148 merges into a shorter linear arm portion 149 which operationally engages the inside face of the cage back wall 144 substantially at its junction with side wall 145 thereof. Projecting medially outwardly of the two arm portions 148 and 149 is a catch arm portion 150 of heavier cross-section, disposed to operationally extend through catch opening 137 in the strike plate's arm portion 136. In its normal unbiased position, the catch arm portion 150 lies substantially at right angles to the linear arm portion 149 and the plane of strike plate 131. Such normal unbiased position is illustrated in FIG. 13 and comprises the bolt capturing position for means 140, whereat the same operatively captures the outer end portion of latch bolt 21 projecting into strike opening 133. In this latter respect, the outer end of the latch bolt also engages and is stopped by the transverse arm portion 135 of the strike plate leaf portion 134, similar to assembly 25.

Upon application of opening force to the door 20, the extended latch bolt 21 forces the arm portion 150 of the catch means to resiliently move away from its normal bolt capturing position, causing the same to retract into opening 137 in arm portion 136 until it reaches a bolt releasing position, indicated by dotted lines in FIG. 13. During the course of such biasing movement of the catch arm portion 150, the curvilinear arm portion 148 deflects toward the strike plate (indicated by the dotted line showing therefor in FIG. 13), lending its flexure to the movement of the relatively rigid catch arm portion 150. As in the previously described structures, with bolt releasing movement of the catch means, the bolt means 21 engages the sloping guide surfaces of the adjacent leaf portion 136. Thus as the door moves in an opening direction, the bolt is forced toward the outer surface of the strike plate to bring about full strike escaping operation thereof.

Thus, as in the heretofore described assemblies of this invention, modified assembly 130 of FIGS. 12 and 13 also accomplishes the emergency door opening objective of this invention.

Having thus described this invention, it is believed that those of normal skill in this art will readily recognize and appreciate its novel advancement over the prior art and will understand that while the same has been described in association with the illustrated preferred and modified embodiments, the principles and concepts hereinabove set forth may be modified and changed without departing from the spirit and scope of this invention, which are intended to be unlimited by the foregoing description, except as may appear in the following appended claims.

The embodiments of the invention in which an exclusive property or privilege is claimed are defined as follows:

1. An emergency release strike assembly for use with a door lock or latch having an axially movable, spring-biased bolt, operably controlled by operator means for latching and unlatching cooperation with a jamb mounted strike, the operator means being selectively lockable to prevent operator controlled unlatching movement of the bolt whereby to lock an associated door in closed position, comprising: a rigid jamb mounted plate having a body portion formed with an opening for entry of the latching end of a bolt, bolt engageable catch means mounted adjacent said body portion for bolt engaging and disengaging movements behind said plate and across said opening whereby to respectively capture and release the latching end of a bolt extending into said opening; yieldable means operatively associated with said catch means to move the same to a bolt capturing position and reactive to the application of predetermined opening force on an associated door to cause movement of said catch means to a bolt releasing position whereby to release the captured end of the bolt, and means cooperable with said bolt for ejecting the released bolt from said opening.

2. The invention of claim 1, wherein said catch means is mounted for linear movements behind and across said opening.

3. The invention of claim 1 wherein said catch means is pivotally mounted, and said yieldable means comprises spring means arranged to bias said catch means in a bolt engaging direction.

4. The invention of claim 1 in which said catch means comprises a pivotally supported bell crank having an arm portion engageable with the said latching end of the bolt whereby to capture the same in door latching position.

5. The invention of claim 4 and cage means supporting said bell crank for pivotal movement, and said yieldable means comprises spring means normally biasing said bell crank in bolt capturing direction.

6. The invention of claim 1 and stop means limiting movement of said catch means in a bolt releasing direction.

7. The invention of claim 1 wherein said means for ejecting said bolt out of said opening comprises inclined portions of said plate adjacent said catch means.

8. The invention of claim 7, wherein said catch element is pivotally mounted for movement transversely of the movement axis of the bolt.

9. The invention of claim 1 wherein said means for ejecting the released bolt comprises means extending partially across said opening and adjacent said catch means to engage the latching end of the bolt and guide the same out of said opening upon releasing operation of said catch means.

10. The invention of claim 1 wherein said catch means comprises a unitary cantilever mounted spring member having one end supported on said plate and its free end positioned to capture the outer end of the bolt.

11. The invention of claim 1 wherein said catch means comprises a molded elastomeric member supported behind said body portion and having an integral arm portion intermediate its ends operable to capture and release the latching end of the bolt.

12. A strike assembly for use with an interior door lock or latch having an axially movable, spring biased bolt, operably controlled by operator means for latching and unlatching cooperation with a jamb mounted strike, comprising: a jamb mounted plate formed with a central opening for entry of the latching end of the bolt, a bolt engageable catch element, mounting means supporting said element for bolt engaging and disengaging movements behind and laterally across said opening whereby to respectively capture and release the latching end of the bolt within said opening; said disengaging movement of said element affording movement of the bolt laterally of said opening; guide means cooperable with the bolt for moving the same out of said opening, and yieldable means operatively associated with said element for opposing said disengaging movement thereof, whereby when the latter is in capturing engagement with the latching end of the bolt, application of force transversely of the bolt axis and sufficient to overcome said yieldable means, produces strike escaping operation of the bolt, independently of its operator controlled movement.

13. The invention of claim 12, wherein said catch element comprises a resilient member having a portion engageable with the latching end of the bolt and which yieldably responds to the application of force thereon to release the same, and said guide means comprises an inclined surface engageable by the released latching end of the bolt to positively guide the same to the exterior surface of said plate.

14. The invention of claim 12, wherein said guide means comprises an inclined surface engageable with the latching end of the bolt for operably guiding such end out of said opening in the releasing position of said catch element.

* * * * *